US010960462B2

(12) United States Patent
Kitahara et al.

(10) Patent No.: US 10,960,462 B2
(45) Date of Patent: Mar. 30, 2021

(54) PRODUCTION METHOD AND PRODUCTION APPARATUS OF CONTINUOUSLY CAST METAL ROD

(71) Applicant: SHOWA DENKO K.K., Tokyo (JP)

(72) Inventors: Masanori Kitahara, Fukushima (JP); Saeha Yamane, Kanagawa (JP)

(73) Assignee: SHOWA DENKO K.K., Tokyo (JP)

( * ) Notice: Subject to any disclaimer, the term of this patent is extended or adjusted under 35 U.S.C. 154(b) by 0 days.

(21) Appl. No.: 16/803,123

(22) Filed: Feb. 27, 2020

(65) Prior Publication Data

US 2020/0276636 A1 Sep. 3, 2020

(30) Foreign Application Priority Data

Feb. 28, 2019 (JP) ..... JP2019-036613

(51) Int. Cl.

| | |
|---|---|
| ***B22D 11/04*** | (2006.01) |
| ***B22D 11/049*** | (2006.01) |
| ***B22D 11/124*** | (2006.01) |
| ***B22D 11/22*** | (2006.01) |
| ***B22D 11/041*** | (2006.01) |

(52) U.S. Cl.

CPC ..... *B22D 11/124* (2013.01); *B22D 11/041* (2013.01)

(58) Field of Classification Search

CPC ..... B22D 11/0403; B22D 11/049; B22D 11/1246; B22D 11/22; B22D 11/225

See application file for complete search history.

(56) References Cited

U.S. PATENT DOCUMENTS 4,597,432 A * 7/1986 Collins ..... B22D 11/049 164/348

FOREIGN PATENT DOCUMENTS

| | | | |
|---|---|---|---|
| JP | 2003211255 A | 7/2003 | |
| JP | 2006051535 A | 2/2006 | |
| WO | WO-8800867 A1 * | 2/1988 | ..... B22D 11/0403 |

OTHER PUBLICATIONS

English Abstract for JP-2003-211255, Publication Date: Jul. 29, 2003.

English Abstract for JP-2006-051535, Publication Date: Feb. 23, 2006.

* cited by examiner

*Primary Examiner* — Kevin E Yoon

(74) *Attorney, Agent, or Firm* — Millen, White, Zelano & Branigan, P.C.; William Nixon

(57) ABSTRACT

A method of producing a continuously cast metal rod capable of producing a high-quality continuously cast material is provided. In the method of producing a continuously cast metal rod, a cooling liquid is supplied to each of outer peripheral surfaces of a plurality of ingots extracted from a plurality of molds in parallel to cool each of the plurality of ingots. In a predetermined ingot, the number of adjacent ingots is the number of other ingots arranged around the predetermined so as to face the predetermined ingot, and an ingot small in the number of adjacent ingots is cooled with weak cooling in which the degree of cooling by the cooling liquid is reduced with respect to an ingot large in the number of adjacent ingots.

5 Claims, 9 Drawing Sheets

PRODUCTION METHOD AND PRODUCTION APPARATUS OF CONTINUOUSLY CAST METAL ROD

TECHNICAL FIELD

The present disclosure relates to a production method and a production apparatus for a continuously cast metal rod for producing a continuously cast material made of metal such as aluminum.

In this specification and claims, unless otherwise specified, the term "aluminum (Al)" is used to include the meaning of an aluminum alloy (Al alloy), and the term "continuous casting" and "continuously cast" are used to include the meaning of "semi-continuous casting" and "semi-continuously cast", respectively.

TECHNICAL BACKGROUND

In various aluminum products based on aluminum materials, forged products produced by forging, rolled products produced by rolling, and extruded products produced by extrusion are often used for products requiring high quality and high strength with less variation. A forging material, a rolling material, and an extrusion material to be subjected to the above-mentioned processing are often produced based on a continuously cast material obtained by continuously casting of aluminum.

As a production apparatus (continuous casting apparatus) for producing a continuously cast material, for example, as shown in Patent Documents 1 and 2 listed below, a vertical-type continuous casting apparatus in which the casting direction is vertically downward is known. In this vertical-type continuous casting apparatus, a molten metal is passed through a mold, and an outer peripheral surface of an ingot is solidified, and cooling water as a cooling liquid (cooling medium) is ejected to the ingot from the entire periphery thereof right under the mold to rapidly cool down the entire ingot.

Conventionally, as a cooling water ejection method for cooling an ingot, as shown in Documents 1 and 2, a method of ejecting cooling water from slit-like or circular hole-like cooling water spouting ports provided around the outer periphery of an ingot is generally used.

In such aluminum continuous casting, the step of cooling an ingot is a very important step, and by being rapidly solidified from the entire periphery of the ingot to the inside thereof (central portion) in a balanced manner, the ingot structure can be controlled in a good state, so that the material crystal structure, the crystalline, and the precipitation behavior become uniform in the entirety of the ingot. Thus, a high quality continuously cast material having a good ingot structure with no variation can be produced.

PRIOR ART DOCUMENT

Patent Document

Patent Document 1: Japanese Unexamined Patent Application Publication No. 2006-51535

Patent Document 2: Japanese Unexamined Patent Application Publication No. 2003-211255

SUMMARY OF THE INVENTION

Problems to be Solved by the Invention

In a conventional continuous aluminum casting method, in order to improve productivity, etc., a so-called multiple continuous casting has been often used in which a number of molds are arranged in parallel and a number of continuously cast rods are continuously cast simultaneously in parallel when a molten metal passes through each mold. In such a multiple continuous casting, since the outer peripheral surface of the continuously cast rod has a complex temperature distribution due to thermal influences between adjacent continuously cast rods, not all continuously cast materials could be cooled in a balanced manner. Therefore, there was a problem that it was difficult to assuredly produce a high quality continuously cast material.

The preferred embodiments of the present invention have been made in view of the abovementioned and/or other problems in the related art. The preferred embodiments of the present invention can significantly improve upon existing methods and/or apparatuses.

The present invention has been made in view of the aforementioned problems and aims to provide a production method and a production apparatus of a continuously cast metal rod capable of cooling all ingots in a balanced manner and producing a high-quality continuously cast material.

The other purposes and advantages of the present invention will be apparent from the following preferred embodiments.

Means for Solving the Problem

In order to solve the abovementioned problems, the present invention has the following means.

[1] A method of producing a continuously cast metal rod in which a cooling liquid is supplied to each of outer peripheral surfaces of a plurality of ingots extracted from a plurality of molds in parallel to cool each of the plurality of ingots, wherein when a number of other ingots arranged around a predetermined ingot so as to face the predetermined ingot is defined as a number of adjacent ingots, an ingot smaller in the number of adjacent ingots is cooled with weak cooling in which a degree of cooling by the cooling liquid is reduced with respect to an ingot larger in the number of adjacent ingots.

[2] The method of producing a continuously cast metal rod as recited in the aforementioned Item [1], wherein a supply quantity of the cooling liquid to the ingot smaller in the number of adjacent ingots is set to be less than a supply quantity of the cooling liquid to the ingot larger in the number of adjacent ingots.

[3] The method of producing a continuously cast metal rod as recited in the aforementioned Item [1] or [2], wherein supply pressure of the cooling liquid to the ingot smaller in the number of adjacent ingots is set to be lower than supply pressure of a cooling liquid to the ingot larger in the number of adjacent ingots.

[4] The method of producing a continuously cast metal rod as recited in any one of the aforementioned Items [1] to [3], wherein the degree of cooling of each ingot is set to be equal to each other over an entire circumference of each ingot.

[5] The method of producing a continuously cast metal rod as recited in any one of the aforementioned Items [1] to [3], wherein when a region of an outer peripheral surface of the ingot which is open and does not face another ingot is defined as an open region, and a region of the outer peripheral surface of the ingot that faces another ingot is defined as an ingot facing region, the open region is cooled in a state in which the degree of cooling by the cooling liquid at the open region is set to be less than the degree of cooling of the cooling liquid at the ingot facing region.

[6] An apparatus of producing a continuously cast metal rods in which a plurality of molds is arranged in parallel and a plurality of cooling liquid spouting ports is provided corresponding to each production apparatus, and a cooling liquid is supplied from the plurality of cooling liquid spouting ports to each of outer peripheral surfaces of the plurality of ingots extracted in parallel from the plurality of molds to cool each of the plurality of ingots, wherein when a number of other ingots arranged around a predetermined ingot so as to face the predetermined ingot is defined as a number of adjacent ingots, a supply quantity adjustment means configured to adjust such that a supply quantity of the cooling liquid to the ingot smaller in the number of adjacent ingots becomes less than a supply quantity of the cooling liquid to the ingot larger in the number of adjacent ingots.

[7] The apparatus of producing a continuously cast metal rod as recited in the aforementioned Item [6], wherein a plurality of the cooling liquid spouting ports is arranged at intervals along an outer periphery of the corresponding ingot and is configured to spout the cooling liquid from respective cooling liquid spouting ports to supply the cooling liquid to an outer peripheral surface of the corresponding ingot, wherein a total opening area of the plurality of cooling liquid spouting ports corresponding to the ingot smaller in the number of adjacent ingots is set to be smaller than a total opening area of the plurality of cooling liquid spouting ports corresponding to the ingot larger in the number of adjacent ingots, and wherein the plurality of cooling liquid spouting ports serve as the supply quantity adjustment means.

[8] The apparatus of producing a continuously cast metal rod as recited in the aforementioned Item [7], wherein a caliber of the plurality of cooling liquid spouting ports corresponding to the ingot smaller in the number of adjacent ingots is set to be smaller than a caliber of the plurality of cooling liquid spouting ports corresponding to the ingot larger in the number of adjacent ingots.

[9] The apparatus of producing a continuously cast metal rod as recited in the aforementioned Item [7] or [8], wherein an interval of the plurality of cooling liquid spouting ports corresponding to the ingot smaller in the number of adjacent ingots is set to be wider than an interval of the plurality of cooling liquid spouting ports corresponding to the ingot larger in the number of adjacent ingots.

[10] The apparatus of producing a continuously cast metal rod as recited in any one of the aforementioned Items [6] to [9], further comprising:

supply pressure adjustment means configured to adjust such that supply pressure of a cooling liquid corresponding to the ingot smaller in the number of adjacent ingots becomes lower than supply pressure of the cooling liquid corresponding to the ingot larger in the number of adjacent ingots, and wherein the supply pressure adjustment means serves as the supply quantity adjustment means.

Effects of the Invention

According to the production method of a continuously cast metal rod of the aforementioned Item [1], since the outer ingot smaller in the number of adjacent ingots is cooled with weak cooling with respect to the inner ingot larger in the number of adjacent ingots, the outer ingot which can be efficiently cooled due to small influence of heat from other ingots can be cooled with weak cooling, so that the inner ingot which cannot be efficiently cooled due to a large influence of heat from other ingots can be cooled with strong cooling. Thus, each ingot can be cooled without bias in a well-balanced manner, which makes it possible to form a good ingot structure. As a result, it is possible to assuredly cast a continuously cast material as a high-quality ingot.

According to the method of producing a continuously cast metal rod as recited in the aforementioned Items [2] to [4], the aforementioned effects can be obtained more assuredly.

According to the method of producing a continuously cast metal rod as recited in the aforementioned Item [5], since the open region of the outer peripheral surface of the ingot which does not face another ingot is cooled with weak cooling with respect to the ingot facing region which faces another ingot, the open region that can be efficiently cooled can be cooled with weak cooling and the ingot facing region that cannot be efficiently cooled can be cooled with strong cooling. Therefore, each ingot can be cooled in a well-balanced manner from the entire periphery to the center portion, which makes it possible to form an even and good ingot structure in the entirety of the ingot. As a result, it is possible to assuredly cast a continuously cast material with no variation as a high-quality ingot.

According to the apparatus for producing a continuously cast metal rod as recited in the aforementioned Item [6], since it is equipped with a supply quantity adjustment means configured to adjust such that a supply quantity of the cooling liquid to the outer ingot smaller in the number of adjacent ingots in the periphery becomes less than a supply quantity of the cooling liquid to the inner ingot larger in the number of adjacent ingots in the periphery, it is possible to cool the outer ingot with weak cooling with respect to the inner ingot. Therefore, similarly to the above, each ingot can be cooled in a balanced manner without bias, and can be formed to have a good ingot structure. Thus, it is possible to assuredly cast a continuously cast material as a high-quality ingot.

According to the production apparatus of a continuously cast metal rod as recited in the aforementioned Items [7] to [10], the abovementioned effects can be obtained more assuredly.

EMBODIMENTS FOR CARRYING OUT THE INVENTION

Figure 1:
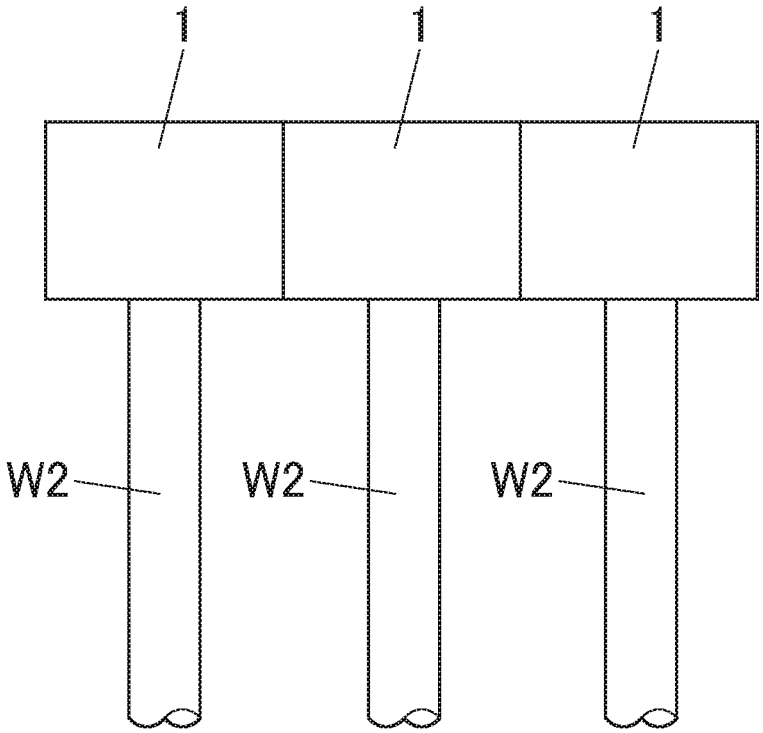
FIG. 1 is a side view schematically showing a vertical-type continuous casting apparatus as a production apparatus of a continuously cast rod according to an embodiment of the present invention.
Figure 2A:
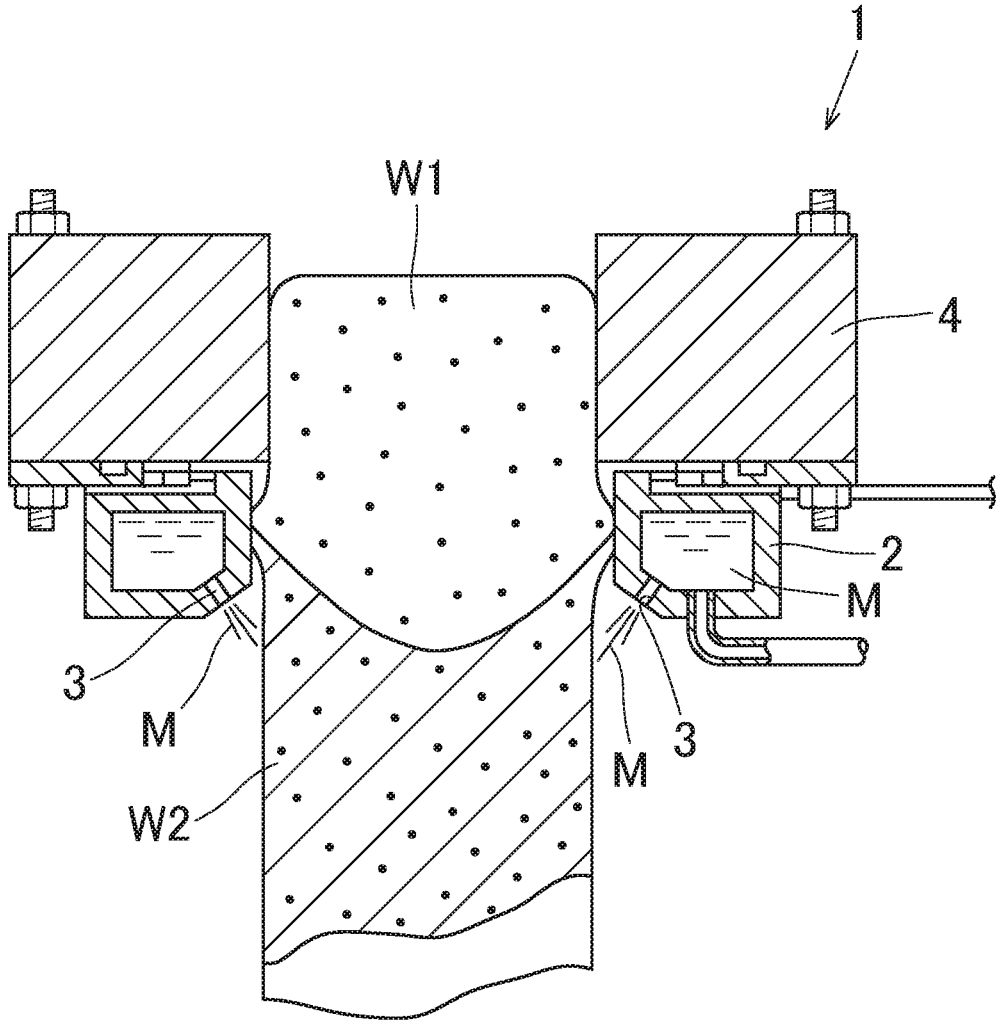
FIG. 2A is a side cross-sectional view showing a hot-top casting machine applied to the continuous casting apparatus of the embodiment.
Figure 2B:
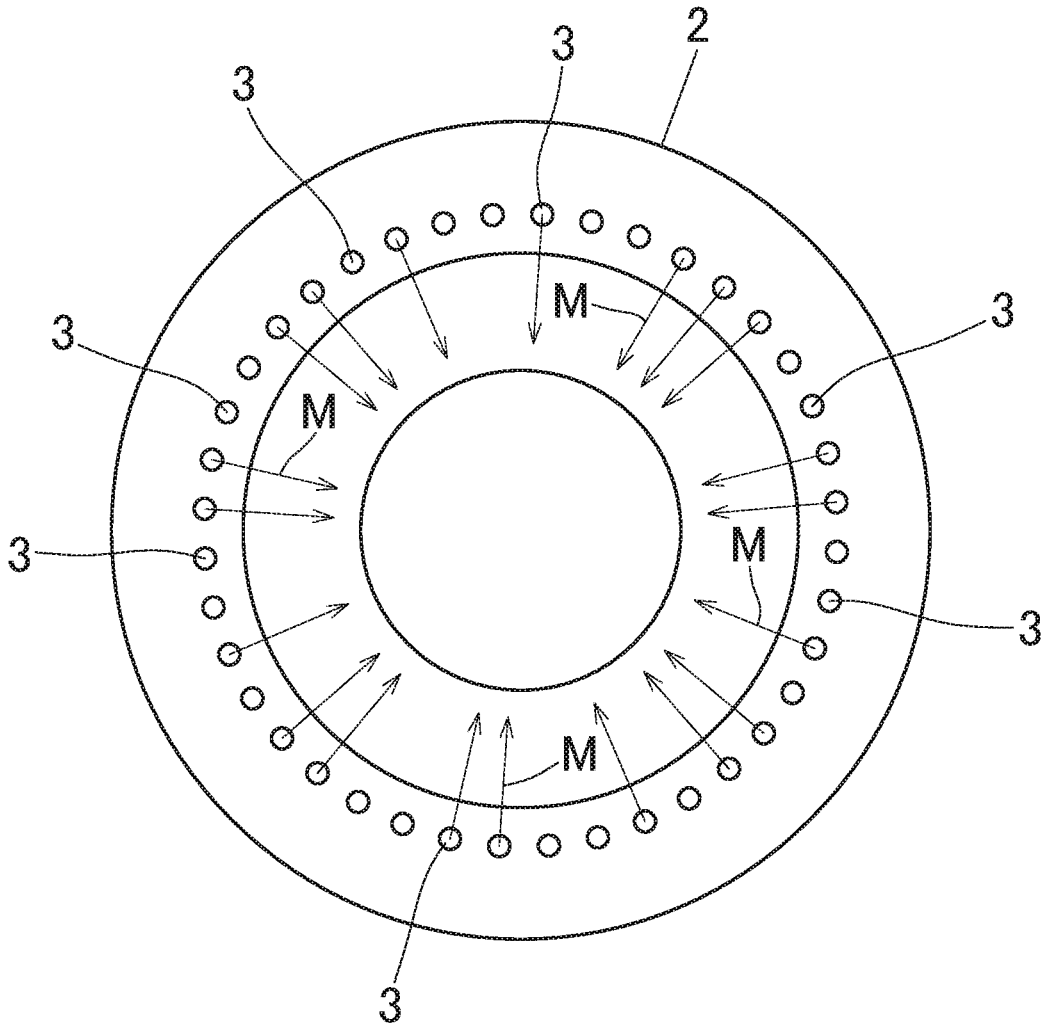
FIG. 2B is a cross-sectional view schematically showing the hot-top casting machine of the embodiment.

FIG. 1 is a side view schematically showing a vertical-type continuous casting apparatus to which a continuous casting apparatus as a production apparatus of a continuously cast aluminum material according to an embodiment of the present invention is applied. FIG. 2A and FIG. 2B are views showing a hot-top casting machine 1 applied to the casting apparatus of the embodiment.

As shown in FIG. 1, the casting apparatus is provided with three hot-top casting machines 1 arranged in parallel. As shown in FIG. 2A and FIG. 2B, each casting machine 1 is provided with a mold 2 for solidifying an aluminum molten metal W1 to cast an ingot W2, spouting ports 3 as cooling liquid spouting ports provided at the lower end portion of each mold 1, and a molten metal receiving tank 4 provided on an upper side of the mold 1 for supplying a molten metal W1 into the mold 2.

The mold 2 is cooled by cooling water M as a primary cooling water supplied therein. The spouting port 3 provided at the lower end of the mold 2 is configured to eject the cooling water (cooling liquid) M in the mold 2 as a secondary cooling water. As shown in FIG. 2B, a plurality of spouting ports 3 is provided in the circumferential direction at appropriate intervals.

In this casting apparatus, an aluminum molten metal W1 as a metal fed in each molten metal receiving tank 4 in each casting machine 1 is supplied in each cooled mold 2. The molten metal W1 supplied in each mold 2 is primarily cooled by coming into contact with each mold 2 to form an ingot W2 in a semi-solidified state. The ingot W2 in the semi-solidified state is in a state in which a coagulation film is formed on its outer peripheral portion.

Each ingot W2 in this state continuously passes through downward in the mold 2, and cooling water M is ejected from each spouting port 31 to the ingot W2 immediately after passing through each mold 2, so that the cooling water M comes into direct contact with the outer peripheral surface of each ingot W2 to cool each ingot W2. In this manner, the ingot W2 is secondarily cooled while being drawn downward, so that the most part is solidified. Thus, three round bar-shaped continuously cast materials (billets) are simultaneously produced in a state in which they are arranged in parallel.

Figure 3:
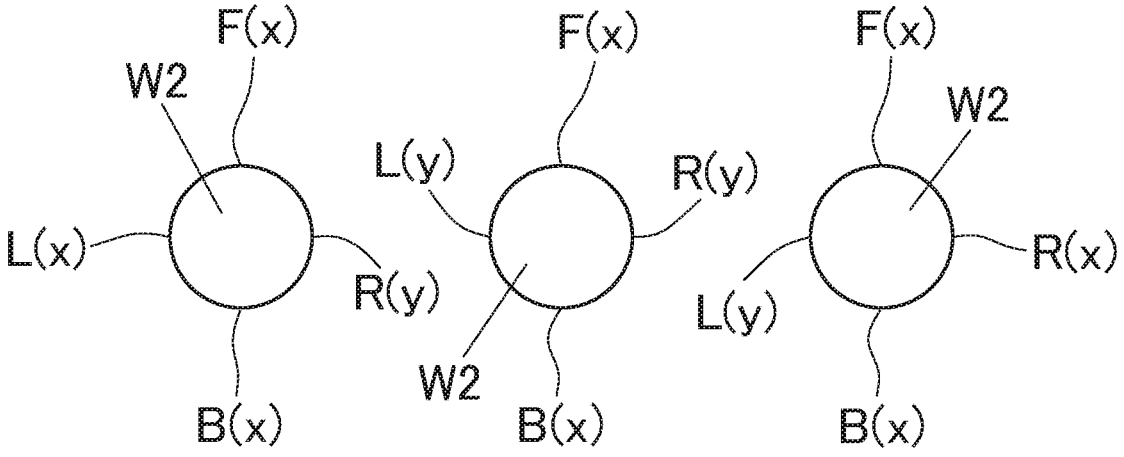
FIG. 3 is a schematic horizontal cross-sectional view for explaining ingots cast by the continuous casting apparatus of the embodiment.

Next, a method of cooling the ingot W2 in the casting apparatus according to an embodiment will be described. FIG. 3 is a schematic cross-sectional view for explaining an ingot (continuously cast rod) W2 cast by the casting apparatus of this embodiment.

As shown in FIG. 3, in the casting apparatus of this embodiment, three pieces of ingots W2 are cast in parallel in a parallel arrangement. In this embodiment, the number of other ingots W2 arranged around a certain ingot (predetermined ingot) so as to face the predetermined ingot is defined as the number of adjacent ingots in the predetermined ingot W2.

For example, in a left ingot W2 positioned at the left end of FIG. 3, since a middle ingot W2 is arranged so as to face the left ingot W2 only on the right side of FIG. 3, the number of adjacent ingots arranged around the left ingot W2 positioned on the left end is "1". Further, in a middle ingot W2 positioned in the middle of FIG. 3, since right and left ingots W2 are arranged so as to face the middle ingot W2 on both the left and right sides, the number of adjacent ingots arranged around the middle ingot W2 is "2". Furthermore, in a right ingot W2 positioned at the right end of FIG. 3, since a middle ingot W2 is arranged so as to face the right ingot W2 only on the left side, the number of adjacent ingots arranged around the right ingot W2 is "1".

In this embodiment, the degree of cooling with respect to each ingot W2 is adjusted based on the number of adjacent ingots. In other words, the outer ingot W2 with a smaller number of adjacent ingots is cooled with weak cooling with a reduced degree of cooling by cooling liquid M with respect to the inner ingot with a larger number of adjacent ingots. For example, in this embodiment, since both the outer side ingots W2 is "1" in the number of adjacent ingots and the middle (inner) ingot W2 is "2" in the number of adjacent ingots, Both the outer ingots W2 smaller in the number of adjacent ingots are cooled with weak cooling in which the degree of cooling is small, and the middle (inner) ingot W2 larger in the number of adjacent ingots is cooled with strong cooling in which the degree of cooling is large. It should be noted that in this embodiment, reducing the degree of cooling means reducing the quantity of heat absorbed from the ingot W2, and increasing the degree of cooling means increasing the quantity of heat absorbed from the ingot W2.

As a means for adjusting the degree of cooling, for example, a configuration can be adopted in which the supply quantity of the cooling water M with respect to an ingot W2 small in the number of adjacent ingots is reduced and the supply quantity of the cooling water M with respect to an ingot W2 large in the number of adjacent ingots is increased.

Specifically, in the outer casting machine 1 (mold 2) for casting an ingot W2 small in the number of adjacent ingots, the total opening area of the spouting ports 3 for supplying the cooling water M is reduced, and in the inner casting machine 1 (mold 2) for casting an ingot W2 large in the number of adjacent ingots, the total opening area of the spouting ports 3 is increased. For example, the hole diameter (caliber) of each spouting port 3 of the outer casting machine 1 is reduced and the hole diameter (caliber) of each spouting port 3 of the inner casting machine 1 is increased. Alternatively, in the outer casting machine 1, the interval (pitch) of adjacent spouting ports 3 in the plurality of spouting ports 3 is set to be wider than the interval (pitch) of adjacent spouting ports 3 in the plurality of spouting ports 3 of the inner casting machine 1. As a result, the supply quantity of the cooling water M is reduced for the outer ingot W2 small in the number of adjacent ingots, so that it is cooled with weak cooling, and the supply quantity of the cooling water M is increased for the inner ingot W2 large in the number of adjacent ingots, so that it is cooled with strong cooling.

Note that in this embodiment, the supply quantity adjustment means is configured by a plurality of spouting ports 3 of each casting machine 1.

Also note that in this embodiment, although the shape of the spouting port 3 is formed in a circular shape, the shape of the spouting port 3 is not particularly limited. In the present invention, a polygonal shape, such as, e.g., an oval shape, an elliptical shape, a slit-like shape, a triangular shape, a square shape, and a mixture thereof can be adopted. Further, even when a spouting port 3 having a shape other than a circular shape is adopted, the degree of cooling can be adjusted by adjusting the caliber and/or the pitch in the same manner as described above.

Specifically, when a slit-like shaped spouting port 3 is adopted, in the outer casting machine 1, the slit width of the spouting port 3 is set to be 1 mm, and in the inner casting machine 1, the slit width of the spouting port 3 is set to be 2 mm. When a circular spouting port 3 is adopted, in the outer casting machine 1, the hole diameter of the spouting port 3 is set to be φ2 mm, and in the inner casting machine 1, the hole diameter is set to be φ3 mm, and further, the interval (pitch) of the spouting ports 3 is set to be 15 degrees pitch in the outer casting machine and 10 degrees pitch in the inner casting machine.

Further, in this embodiment, the weak cooling and the strong cooling can be switched by adjusting the supply pressure (water pressure) of the cooling water M from the spouting port 3. For example, the water pressure of the cooling water M ejected from the spouting port 3 of the casting machine 1 on the weak cooling side is set to be lower than the water pressure of the cooling water M ejected from the spouting port 3 of the casting machine 1 on the strong cooling side. As a result, the cooling water M is supplied at low pressure and low speed to cool the ingot W2 small in the number of adjacent ingots, and the cooling water M is supplied at high pressure and high speed to cool the ingot W2 large in the number of adjacent ingots.

As described above, according to this embodiment, since the outer ingot W2 small in the number of adjacent ingots is cooled with weak cooling with respect to the inner ingot W2 large in the number of adjacent ingots, all of the ingots W2 can be cast with high quality.

That is, since the ingot W2 to be cast is affected by heat from other adjacent ingots W2, the outer ingot W2 small in the number of adjacent ingots is hardly affected by heat from other ingots W2 and is high in cooling efficiency. On the other hand, the inner ingot W2 large in the number of adjacent ingots is easily affected by heat from other ingots W2 and is low in cooling efficiency. Therefore, in this embodiment, since the outer ingot W2 high in cooling efficiency is cooled with weak cooling as compared with the inner ingot W2 low in cooling efficiency, each ingot can be cooled uniformly without bias. Thus, each ingot can be formed to have a good ingot structure, and therefore a high-quality ingot (continuously cast material) W2 with no variation can be assuredly cast.

Further, in this embodiment, by cooling the outer ingot W2 with weak cooling, excessive cooling can be prevented, thereby preventing energy required for cooling from being wasted unnecessarily, which in turn can perform cooling more efficiently. Thus, the productivity of a cast product can be further enhanced.

Note that in the above embodiment, the case in which each ingot W2 to be cast is uniformly cooled at the same degree of cooling over the entire circumference thereof is exemplified, but the present invention is not limited to this. In the present invention, as will be described below, cooling may be performed by varying the degree of cooling according to the circumferential position (region) for each ingot W2. That is, in the present invention, when the degree of cooling of the outer ingot W2 small in the number of adjacent ingots is set to be less than that of the inner ingot W2 large in the number of adjacent ingots, the degree of cooling (heat absorption amount) of the entire outer ingot W2 may be set to be less than the degree of cooling (heat absorption amount) of the entire inner ingot W2.

Figure 4:
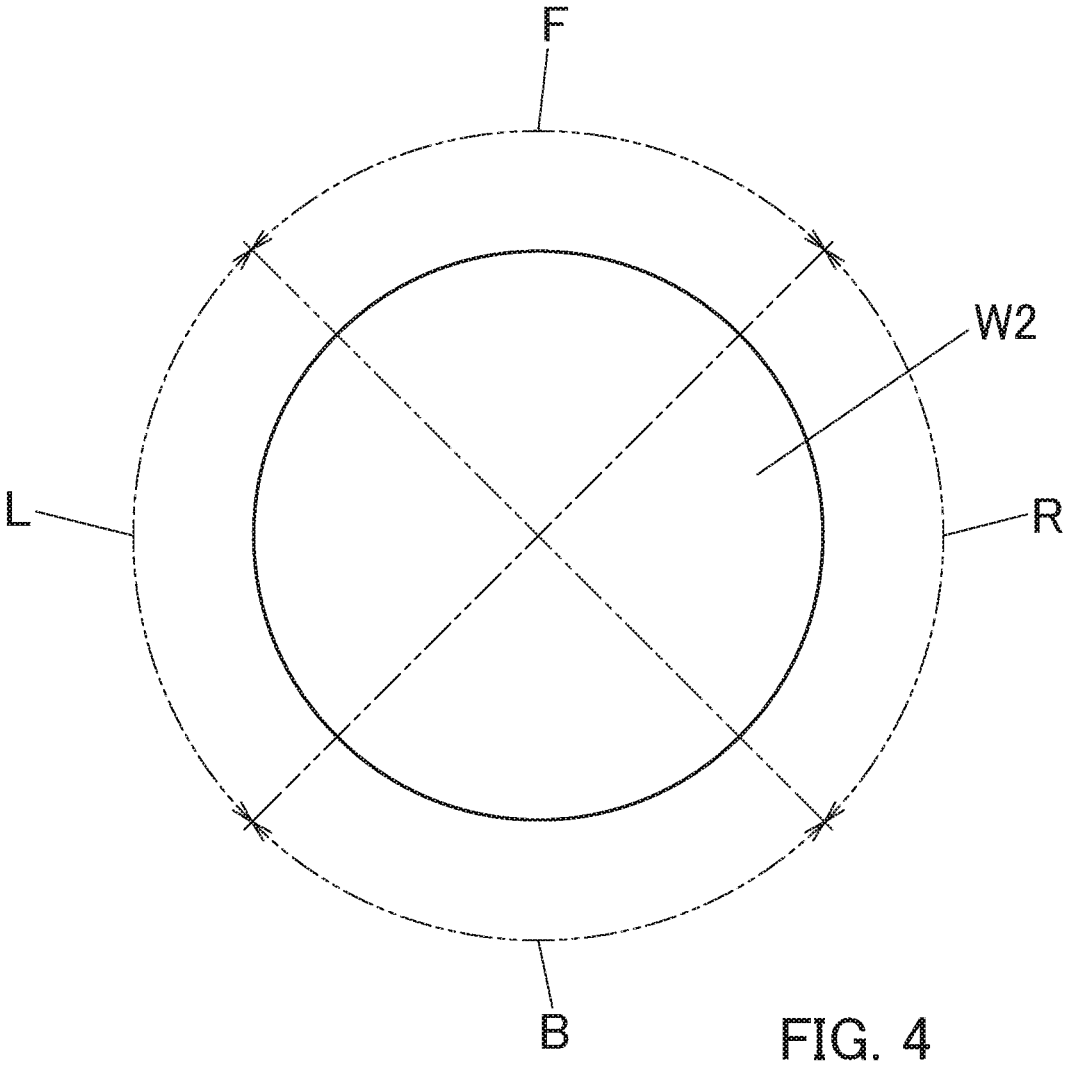
FIG. 4 is a schematic horizontal cross-sectional view for explaining an outer peripheral surface region of an ingot cast by the continuous casting apparatus of the embodiment.

In the present invention, a cooling method for cooling each ingot W2 by varying the degree of cooling according to the circumferential position (region) will be described. FIG. 4 is a schematic horizontal cross-sectional view for explaining the region of the outer peripheral surface of the ingot (continuously cast rod) W2 cast by the casting apparatus of this embodiment.

As shown in FIG. 3 and FIG. 4, in this embodiment, three pieces of ingots W2 are cast in parallel in a parallel arrangement. The outer peripheral surface of each ingot W2 to be cast is divided into four regions in the circumferential direction.

That is, the outer peripheral surface of the ingot W2 is divided into four equal regions in the circumferential direction. Among the divided regions, the region of the front side (the upper region in FIG. 3 and FIG. 4) is defined as a front side region F, the region of the back side (the lower region in FIG. 3 and FIG. 4) is defined as a back side region B, the region of the right side (the right side region in FIG. 3 and FIG. 4) is defined as a right side region R, and the region of the left side (the left side region in both figures) is defined as a left side region L. Further, of the four regions, the region closed by another ingot W2 by facing the another adjacent ingot W2 is defined as an "ingot facing region y", and the region not facing another adjacent ingot W2, i.e., the region where another ingot W2 is not present and is open, is defined as an "open region x". For example, in the ingot W2 positioned at the left end of FIG. 3, the front side region F, the back side region B, and the left side region L are defined as open regions x, and the right side region R is defined as an ingot facing region y. Further, in the ingot W2 positioned in the middle of FIG. 3, the front side region F and the back side region B are defined as open regions x, and the left side region L and the right side region R are defined as ingot facing regions y. Further, in the ingot W2 positioned at the right end of FIG. 3, the front side region F, the back side region B, and the right side region R are defined as open regions x, and the left side region L is defined as an ingot facing region y.

In this embodiment, when cooling the ingot W2 by ejecting cooling water M, the degree of cooling to the open region x is set to be less than the degree of cooling to the ingot facing region y so that the open region x is cooled with weak cooling and the ingot facing region y is cooled with strong cooling.

Here, in this embodiment, it should be noted that reducing the degree of cooling means that the amount of heat absorbed from the ingot W2 is reduced, and on the contrary, increasing the degree of cooling means that the amount of heat absorbed from the ingot W2 is increased. Also note that, in the present invention, the open region x denotes a region not facing another ingot W2, and is not required to be completely open. For example, in the present invention, even if the open region x is closed by a member other than an ingot, such as, e.g., a housing wall, it can be regarded as an open region as long as it does not face another ingot W2.

Figure 5A:
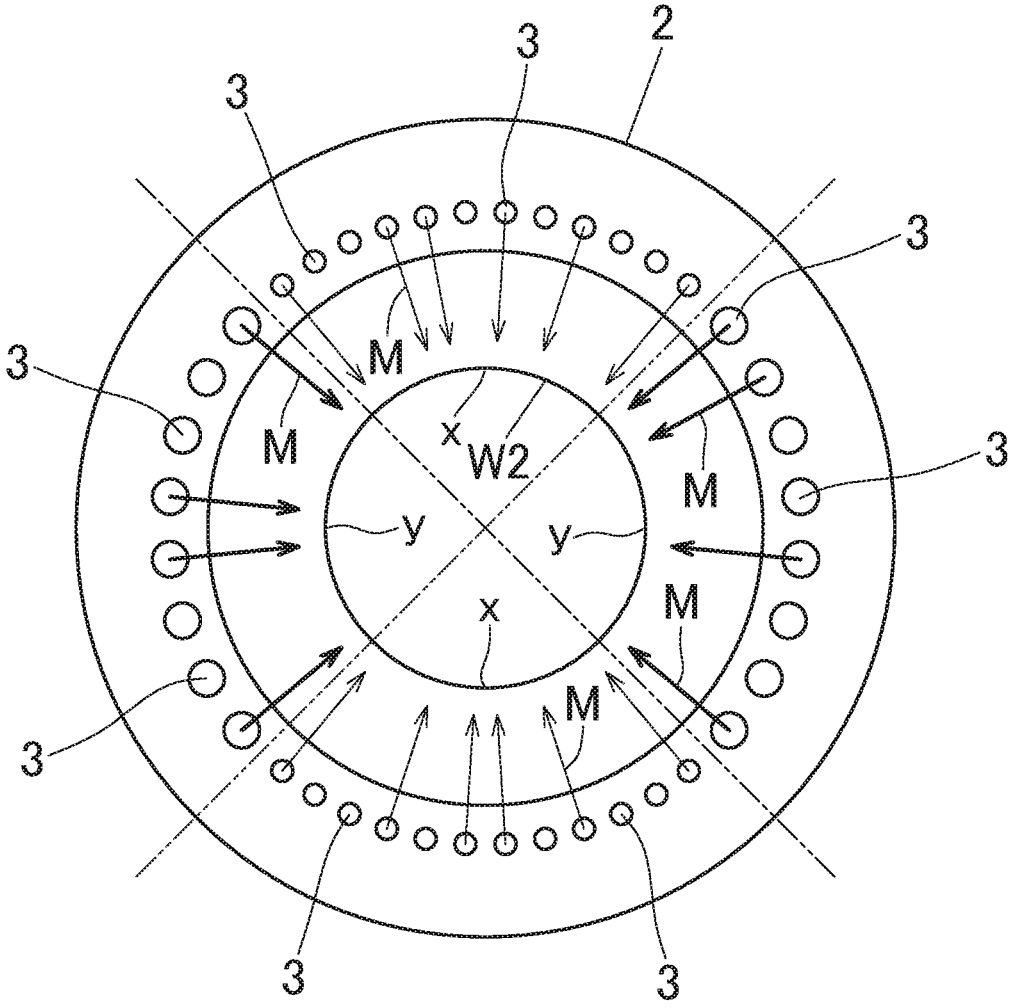
FIG. 5A is a horizontal cross-sectional view schematically showing a hot-top casting machine of a continuous casting apparatus according to a first modified embodiment of the present invention.

Next, the cooling method of a modified example will be specifically explained. FIG. 5A is a horizontal cross-sectional view schematically showing a hot-top casting machine 1 of the continuous casting apparatus according to a first modified embodiment of the present invention. As shown in FIG. 5A, in the mold 2 of each casting machine 1 in the casting apparatus of the first modified embodiment, a cooling water spouting port 3 is formed corresponding to the outer peripheral surface of the ingot W2 to be cast. A plurality of the spouting ports 3 is arranged in the circumferential direction at equal intervals. In the casting machine 1, in the spouting port 3 arranged corresponding to the open region x of the outer peripheral surface of the ingot W2 to be cast, the hole diameter (caliber) is formed to be smaller than that of the spouting port 3 arranged corresponding to the ingot facing region y. As a result, cooling water M is ejected to the open region x from the spouting port 3 having a small caliber, and cooling water M is ejected to the ingot facing region y from the spouting port 3 having a large caliber. Thus, the supply quantity of the cooling water M to the open region x becomes less than that of the ingot facing region y, so that the open region x is cooled with weak cooling and the ingot facing region y is cooled with strong cooling.

Figure 5B:
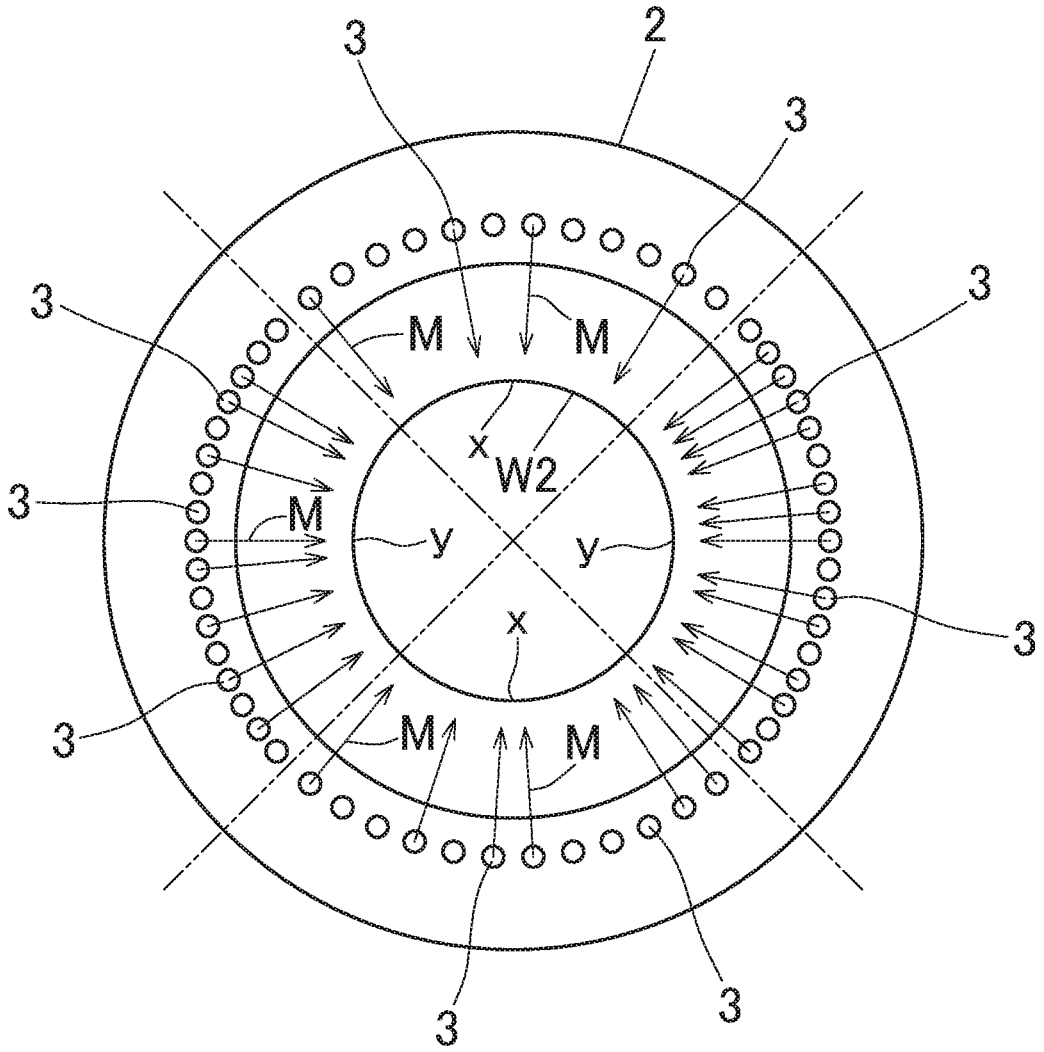
FIG. 5B is a horizontal cross-sectional view schematically showing a hot-top casting machine of a continuous casting apparatus according to a second modified embodiment of the present invention.

FIG. 5B is a horizontal cross-sectional view schematically showing a casting machine 1 according to a second modified embodiment of the present invention. As shown in this figure, in the casting machine 1, although the respective calibers of the plurality of spouting port 3 are configured to be the same in size (hole diameter), the interval (pitch) between the adjacent spouting ports 3 of the plurality of spouting ports 3 arranged in the open region x is set to be wider than the interval (pitch) between the adjacent spouting ports 3 of the plurality of spouting ports 3 arranged in the ingot facing region y. As a result, cooling water M is ejected to the open region x from the spouting ports 3 in which the pitch is wide and spacely arranged, cooling water M is ejected to the ingot facing region y from the spouting ports 3 in which the pitch is narrow and densely arranged. Thus, the supply quantity of the cooling water M in the open region x becomes less than that in the ingot facing region y, and the open region x is cooled with weak cooling, and the ingot facing region y is cooled with strong cooling.

As in the first and second modified embodiments, by setting the total open area of the spouting ports 3 corresponding to the open region x to be smaller than the total open area of the spouting ports 3 corresponding to the ingot facing region y, the open region x can be cooled with weak cooling as compared with the ingot facing region y. Note that in this embodiment, a supply quantity adjustment means is composed of a plurality of spouting ports 3 different in caliber and/or pitch.

In the above-mentioned embodiment, the shape of the spouting port 3 is formed in a circular shape, but the shape of the spouting port 3 is not particularly limited. In the present invention, an oval shape, an elliptical shape, a slit-like shape, a polygonal shape such as a triangle and a quadrangle, a different shape, a mixture of these shapes or the like can be employed. Further, even when a spouting port 3 having a shape other than a circular shape is employed, the degree of cooling can be adjusted by adjusting the caliber and/or the pitch in the same manner as described above.

Specifically, when a slit-like spouting port 3 is adopted, the slit width is changed stepwise or continuously so that the slit width is 1 mm in the spouting port 3 for weak cooling and the slit width is 2 mm in the spouting port 3 for strong cooling. When a circular spouting port 3 is adopted, the hole diameter is changed stepwise or continuously so that the hole diameter is φ2 mm in the spouting port 3 for weak cooling and the hole diameter is φ3 mm in the spouting port 3 for strong cooling, or the pitch is changed stepwise or continuously so that the interval (pitch) between adjacent spouting ports is 15 degrees in the portion for weak cooling and the pitch is 10 degrees in the portion for strong cooling.

Figure 5C:
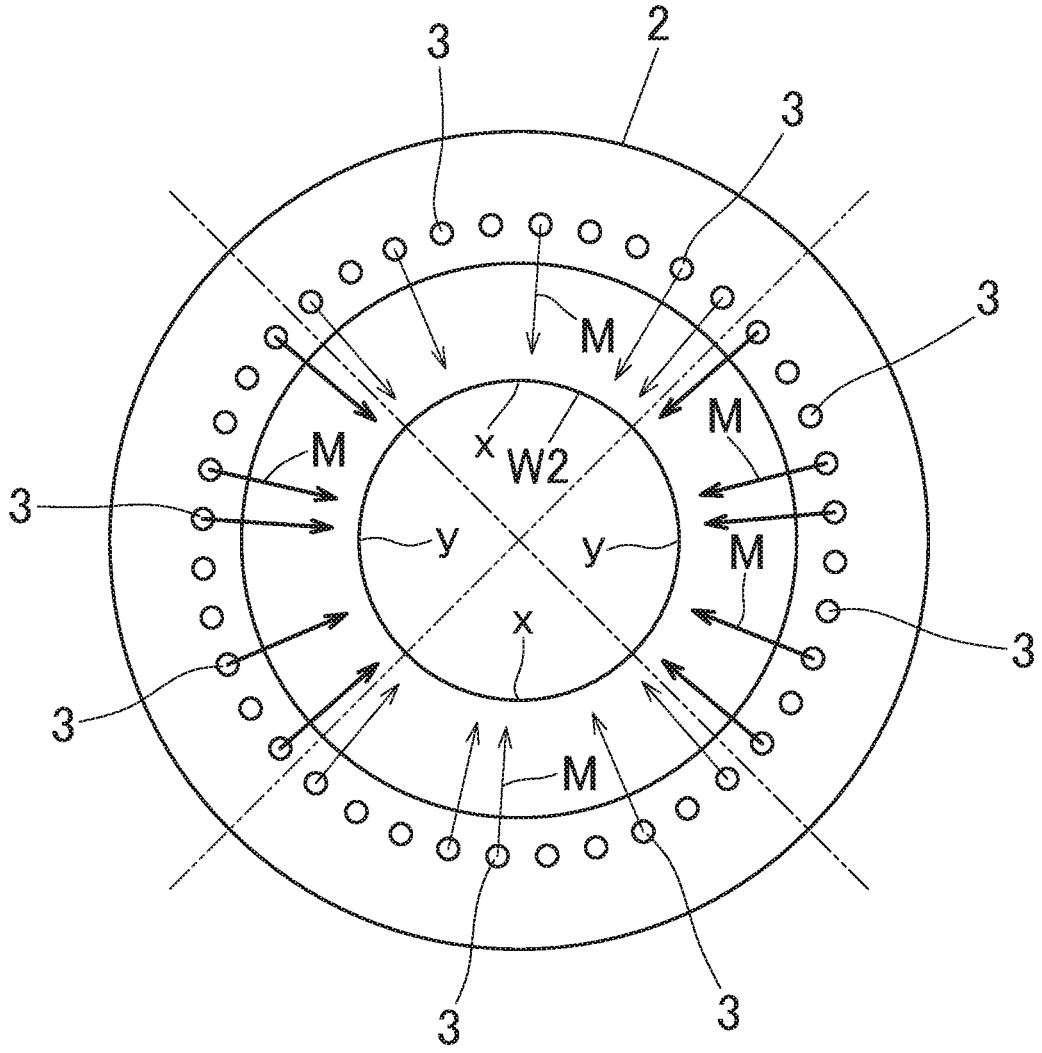
FIG. 5C is a horizontal cross-sectional view schematically showing a hot-top casting machine of a continuous casting apparatus according to a third modified embodiment of the present invention.

In this embodiment, the open region x can also be cooled with weak cooling by adjusting the supply pressure (water pressure) of the cooling water M from the spouting port 3. That is, FIG. 5C is a horizontal cross-sectional view schematically showing a casting machine 1 which is a third modified embodiment of the present invention. As shown in FIG. 5C, in the mold 2 of the casting machine 1, a plurality of spouting ports 3 having the same caliber is formed at equal intervals in the circumferential direction. The water pressure of the cooling water M ejected from the spouting port 3 arranged corresponding to the open region x is set to be lower than the water pressure of the cooling water M ejected from the spouting port 3 arranged corresponding to the ingot facing region y. As a result, the cooling water M is supplied to the open region x at a low pressure and a low speed, the cooling water M is supplied to the ingot facing region y at a high pressure and a high speed. Thus, the supply quantity of the cooling water M to the open region x becomes smaller than that to the ingot facing region y, so that the open region x is cooled with weak cooling and the ingot facing region y is cooled with strong cooling.

In the third modified embodiment, the supply quantity adjustment means is constituted by a water pressure adjustment means (supply pressure adjustment means) such as a water flow pump for adjusting the hydraulic pressure of the cooling water M.

In the present invention, a water pressure adjustment means capable of adjusting the water pressure of the cooling water M may be provided for each spouting port 3. In this case, the water pressure of the cooling water M can be finely adjusted for each spouting port 3, so that the cooling degree can be more finely adjusted, which in turn makes it possible to cast a higher-quality continuously cast material. However, if a water pressure adjustment means is provided for each spouting port 3, the number of installed water pressure adjustment means increases. For this reason, there is a risk that the structure may become complicated and the cost may increase.

In the modified embodiments of FIG. 5A to FIG. 5C, the hole diameter, the hole pitch, the water pressure, etc., may be continuously changed so that the amount of cooling water M gradually increases from the circumferential intermediate position of the open region x to the circumferential intermediate position of the ingot facing region y. Alternatively, a constant small amount of water may be supplied to the entire area of the open region x and a constant large amount of water may be supplied to the entire area of the ingot facing region y so that the amount of water varies stepwise between the open region x and the ingot facing region y.

Note that, in this embodiment, the degree of cooling is adjusted by adjusting the caliber and/or the pitch of the spouting port 3 or by adjusting the water pressure of the cooling water M from the spouting port 3, but the present invention is not limited to this. In the present invention, the degree of cooling can be adjusted by changing the temperature of the cooling water or the type of the cooling water (cooling liquid). For example, by setting the temperature of the cooling water M sprayed to the outer ingot W2 or the open region x to be higher than the temperature of the cooling water M sprayed to the inner ingot W2 or the ingot facing region y, the open region x can be cooled with weak cooling. Further, as the cooling liquid to be sprayed to the inner ingot W2 or the ingot facing region y, by adopting a cooling liquid having a higher cooling capacity than the cooling liquid to be sprayed to the outer ingot W3 or the open region x, the open region x can be cooled with a weak cooling weaker than the inner ingot W2 or the ingot facing region y.

As described above, according to this modified embodiment, in the continuous casting apparatus in which a plurality of ingots (continuously cast material) W2 is cast in parallel, the open region x of the outer peripheral surface of a predetermined ingot W2 which does not face another ingot W2 is cooled with weak cooling with respect to the ingot facing region y facing another ingot W2. Therefore, all of the ingots W2 can be cast with high quality.

That is, of the outer peripheral surface of the ingot W2, the open region x is hardly affected by heat from another ingot W2, and therefore the cooling efficiency is high, whereas the ingot facing region y is easily affected by heat from another adjacent ingot W2, and therefore the cooling efficiency is low. Therefore, in this embodiment, since the open region x having a high cooling efficiency is cooled with weak cooling as compared with the ingot facing region y having a low cooling efficiency, the respective ingots W2 can be cooled in a well-balanced manner from the entire circumference to the center portion. Thus, the entire ingot can be formed into a uniform and good ingot structure. For this reason, a high-quality ingot (continuously cast material) W2 with no variation can be assuredly cast.

Besides, in this modified embodiment, in the same manner as in the aforementioned embodiment, by cooling the open region x with weak cooling, excessive cooling can be prevented, so that the energy required for cooling can be prevented from being wasted unnecessarily. As a result, cooling can be more efficiently performed, which in turn can improve the productivity of a cast product.

In the aforementioned embodiment, a case in which the present invention is applied to three ingots W2 arranged in one row is exemplified, but the present invention is not limited to this. The present invention can also be applied to a plurality of ingots arranged in two or more rows and two or more columns in the same manner as described above.

Figure 6:
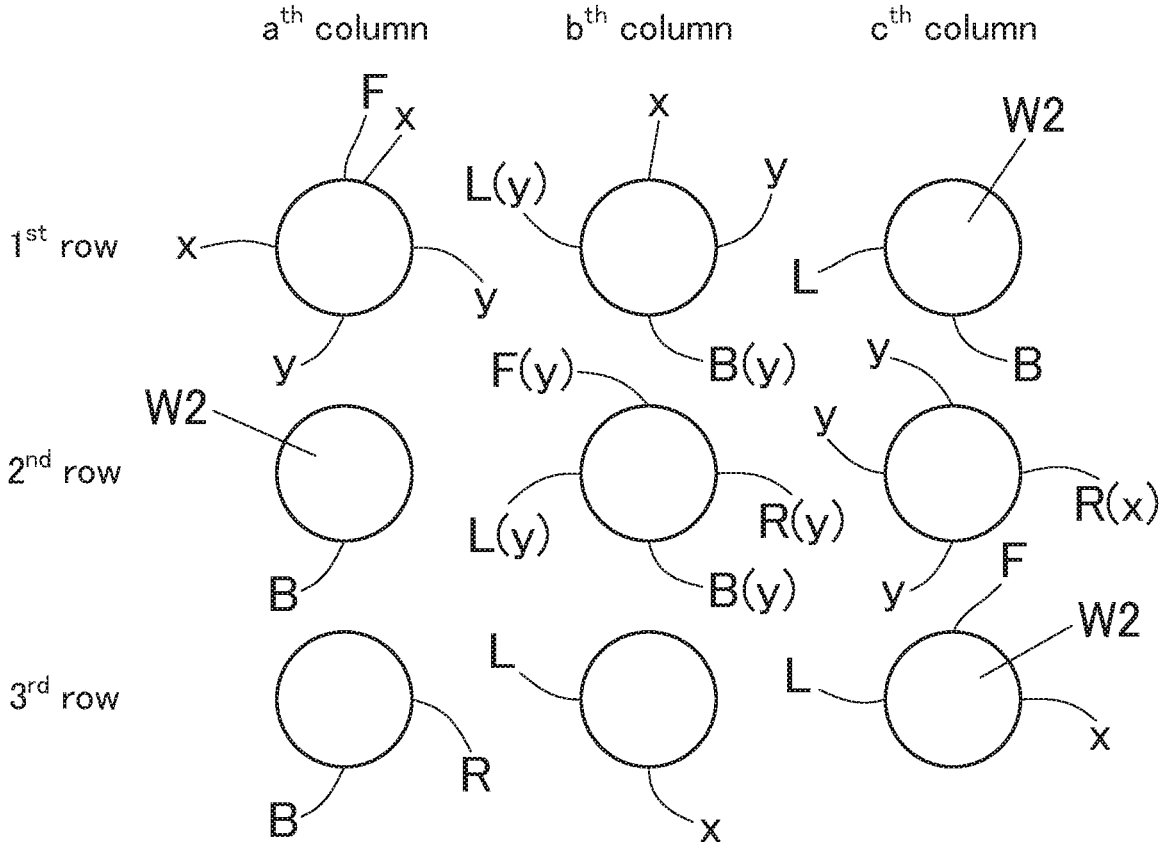
FIG. 6 is a schematic horizontal cross-sectional view for explaining a cooling method of ingots in a continuous casting apparatus according to another embodiment of the present invention.

For example, as shown in FIG. 6, in a continuous casting apparatus according to another embodiment of the present invention, a total of nine pieces of ingots W2 arranged in three rows and three columns are simultaneously cast in parallel. In this embodiment, to facilitate understanding of the present invention, in FIG. 6 the $1^{st}$ row from the top will be defined as a $1^{st}$ row, the $2^{nd}$ row from the top will be defined as a $2^{nd}$ row, and the $3^{rd}$ (lowest) row from the top will be defined as a $3^{rd}$ row. Further, the leftmost column will be defined as an $a^{th}$ column, the $2^{nd}$ column from the left will be defined as a $b^{th}$ column, and the rightmost column will be defined as a $c^{th}$ column.

In the embodiment of FIG. 6, in the ingot W2 arranged in the $1^{st}$ row and $a^{th}$ column (upper left), since other ingots W2 are arranged so as to facing it on the right side and the back side, the number of adjacent ingots is "2". Further, in the ingot W2 arranged in the $1^{st}$ row and $b^{th}$ column, since other ingots W2 are arranged so as to face it on the left, right, and back sides thereof, the number of adjacent ingots is "3". Further, in the ingot W2 arranged in the $2^{nd}$ row and $b^{th}$ column (center), since other ingots W2 are arranged so as to face it on all of the front, back, left, and right sides thereof, the number of adjacent ingots is "4".

Thus, in the ingots W2 arranged at the corner portions, in the $1^{st}$ row and $a^{th}$ column (upper left), the $1^{st}$ row and $c^{th}$ column (upper right), the $3^{rd}$ row and $a^{th}$ column (lower left), in the $3^{rd}$ row and $c^{th}$ column (lower right), the number of adjacent ingots is "2". In the ingot W2 arranged in the middle of the outer periphery in the $1^{st}$ row and $b^{th}$ column, the $2^{nd}$ row and $a^{th}$ column, in the $2^{nd}$ row and $c^{th}$ column, and in the $3^{rd}$ row and $b^{th}$ column, the number of adjacent ingots is "3". In the ingot W2 arranged in the center ($2^{nd}$ row and $b^{th}$ column), the number of adjacent ingots is "4".

Therefore, in this embodiment, the respective ingots W2 are cooled so that the degree of cooling increases in the order of the ingot W2 in the corner portion, the ingot W2 in the middle of the outer periphery, and the ingot W2 in the center.

Further, also in the embodiment of FIG. 6, each ingot W2 to be cast may be uniformly cooled at the same degree of cooling over the entire circumference thereof, or each ingot W2 may be cooled by differentiating the degree of cooling in accordance with the circumferential position (region) as shown in FIG. 5A to FIG. 5C.

For example, in the embodiment of FIG. 6, in the ingot W2 arranged in the $1^{st}$ row and $a^{th}$ column (upper left), the front side region F and left side region L in the outer peripheral surface are open regions x, and the back side region B and the right side region R are ingot facing regions y. Further, in the ingot W2 arranged in the $1^{st}$ row and $b^{th}$ column, only the front side region F is the open region x, and the back side region B and both side surfaces region L and R are ingot facing regions y. In the ingot W2 arranged in the $2^{nd}$ row and $b^{th}$ column (center), all the regions F, B, L, and R around the front, back, left, and right are ingot facing regions y, and in the ingot W2 arranged in the $2^{nd}$ row and $b^{th}$ column, the entire circumference is cooled at the same degree, that is, with strong cooling, without adjusting the degree of cooling. Therefore, in the present invention, for the ingot W2 arranged in three or more rows and three or more columns, in the ingot W2 arranged in the outer periphery, with the exception of the ingot W2 in the center thereof, the open region x is cooled with weak cooling as compared with the ingot facing region y.

Figure 7:
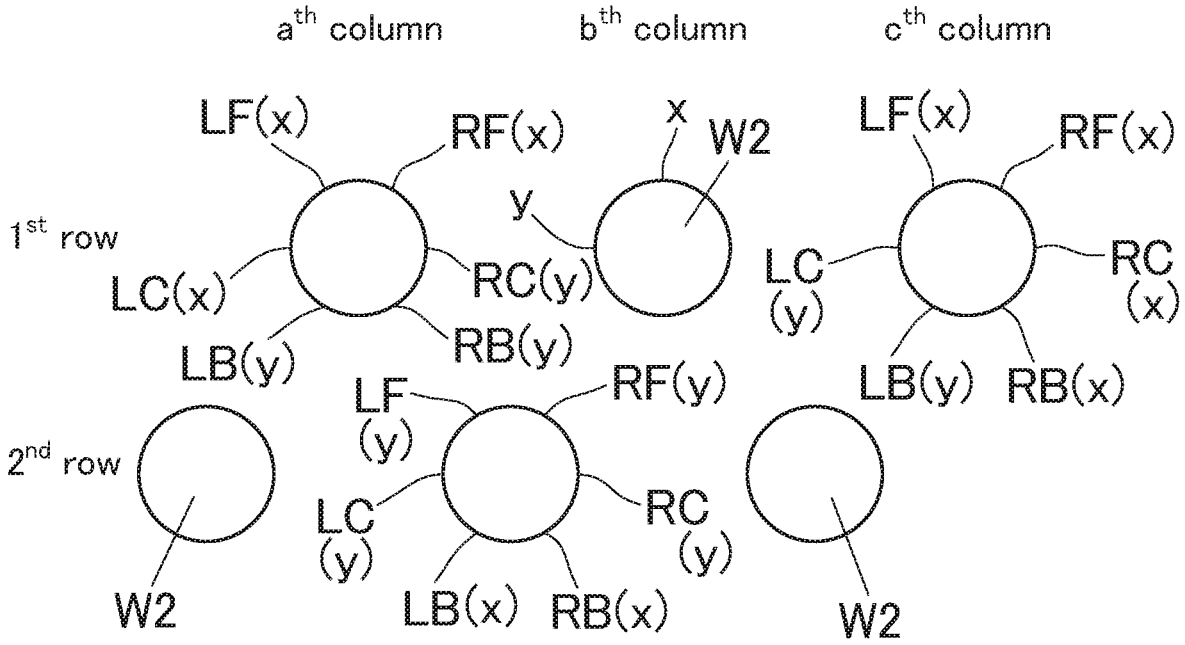
FIG. 7 is a schematic horizontal cross-sectional view for explaining a cooling method of ingots in a continuous casting apparatus according to still another embodiment of the present invention.

FIG. 7 is a schematic horizontal cross-sectional view for explaining the cooling method of ingots in the continuous casting apparatus, which is another embodiment of the present invention. In this embodiment, ingots W2 are cast simultaneously in parallel in a state in which ingots are arranged in two rows from front to back and three columns from left to right (a to c columns). In the ingot W2 arrangement form, in the aforementioned another embodiment or the like as shown in the aforementioned FIG. 6, the present invention is applied to the ingots W2 of the so-called square arrangement in which the axes of the four adjacent ingots W2 are located at the four vertices of the square in a plan view. On the other hand, the embodiment shown in FIG. 7 is a case in which the present invention is applied to the embodiment of the so-called regular triangle arrangement in which the axes of the three adjacent ingots W2 are located at the three vertices of the regular triangle in a plan view.

In this embodiment, in the ingot W2 arranged in the $1^{st}$ row and $a^{th}$ column (upper left) and the $2^{nd}$ row and $c^{th}$ column (lower right), three other ingots W2 are arranged on the periphery so as to face it, so the number of adjacent ingots is "3". In the ingot W2 arranged in the $1^{st}$ row and $c^{th}$ column (upper right) and in the $2^{nd}$ row and $a^{th}$ column (lower left), the number of adjacent ingots is "2" because two other ingots W2 are arranged on the periphery so as to fact it. In the ingots W2 arranged in the $1^{st}$ row and $b^{th}$ column (upper center) and in the $2^{nd}$ row $b^{th}$ column (lower center), the number of adjacent ingots is "4" because four other ingots W2 are arranged on the periphery so as to face it.

Therefore, in this embodiment, the respective ingots W2 are cooled so that the degree of cooling increases in the order of the upper right and lower left ingots W2, the upper left and lower right ingots W2, and the upper center and lower center ingots W2.

It should be noted that, in the embodiment of FIG. 7, each ingot W2 to be cast may be uniformly cooled at the same degree of cooling over the entire circumference thereof. Alternatively, the degree of cooling may be differentiated for each ingot W2 in accordance with the circumferential position (region) as shown in FIG. 5A to FIG. 5C.

Figure 8:
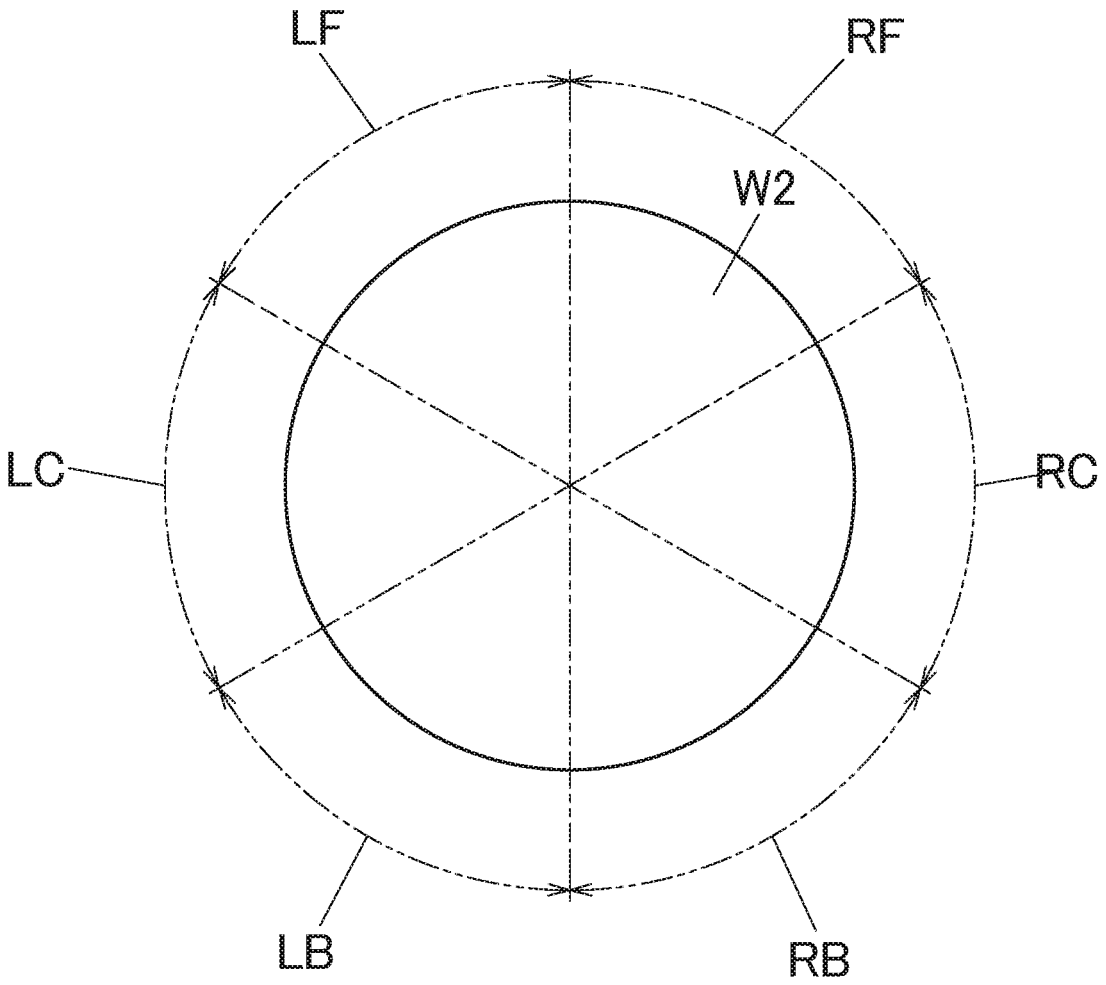
FIG. 8 is a schematic horizontal cross-sectional view for explaining an outer peripheral side region of an ingot by a continuous casting apparatus according to the aforementioned another embodiment.

That is, as shown in FIG. 8, the outer peripheral surface of each ingot W2 is divided into six equal regions. Of the divided regions, the intermediate region on the left side is defined as a left center region LC, the front side region on the left side is defined as a left front side region LF, the back side region on the left side is defined as a left back side region LB, the center region on the right side is defined as a right center region RC, the front side region on the right side is defined as a right front side region RF, and the back side region on the right side is a right back side region RB.

For example, in the ingot W2 of the $1^{st}$ row and $a^{th}$ column (upper right in FIG. 7), the left front side region LF and the right front side region RF are open regions x, and the right center region RC, the right back side region RB and the left back side region LB are ingot facing regions y. Therefore, the open region x is cooled with weaker cooling as compared with the ingot facing region y.

In the ingot W2 arranged in the $1^{st}$ row and $c^{th}$ column (upper right in FIG. 7), the left front side region LF, the right front side region RF, the right center region RC, and the right back side region RB are defined as open regions x, and the left center region LC, and the left back side region LB are defined as ingot facing regions y. Therefore, the open regions x is cooled with weak cooling as compared with the ingot facing regions y.

Further, in the ingot W2 arranged in the $2^{nd}$ row and the $b^{th}$ column, the left back side region LB and the right back side region RB are defined as open regions x, and the left center region LC, the left front side region LF, the right front side region RF, and the right center region RC are defined as ingot facing regions y. Therefore, the open regions x are cooled with weak cooling.

As described above, for ingots W2 which are cast in an equilateral triangular arrangement, the outer peripheral surface thereof may be divided into six equal regions in the circumferential direction, and either the open region x or the ingot facing region y may be set for each region LC, LF, LB, RC, RF, and RB divided into six equal regions.

In the aforementioned embodiments, the present invention is applied to a vertical-type continuous casting apparatus in which the casting direction is set in a vertical direction as an example, but the present invention is not limited to this, and can also be applied to, for example, a horizontal-type continuous casting apparatus in which the casting direction is set in a direction other than a vertical direction.

INDUSTRIAL APPLICABILITY

The production apparatus of a continuously cast metal rod of the present invention can be suitably used for producing a continuously cast material used as a material for an extrusion material, a rolled material, a forged material, etc., made of metal such as aluminum.

The present application claims priority to Japanese Patent Application No. 2019-36613, filed on Feb. 28, 2019, the entire disclosure of which is incorporated herein by reference in its entirety.

It should be understood that the terms and expressions used herein are used for explanations and have no intention to be used to construe in a limited manner, do not eliminate any equivalents of features shown and mentioned herein, and allow various modifications falling within the scope of the present invention.

DESCRIPTION OF SYMBOLS

1: casting machine
2: mold
3: spouting port
X: open region
Y: ingot facing region
M: cooling water (cooling liquid)
W2: ingot (continuously cast material)

The invention claimed is:

1. A method of producing a continuously cast metal rod in which a cooling liquid is supplied to each of outer peripheral surfaces of a plurality of ingots extracted from a plurality of molds in parallel to cool each of the plurality of ingots, wherein when a number of other ingots arranged around a predetermined ingot so as to face the predetermined ingot is defined as a number of adjacent ingots, an ingot smaller in the number of adjacent ingots is cooled with weak cooling in which a degree of cooling by the cooling liquid is reduced with respect to an ingot larger in the number of adjacent ingots.

2. The method of producing a continuously cast metal rod as recited in claim 1, wherein a supply quantity of the cooling liquid to the ingot smaller in the number of adjacent ingots is set to be less than a supply quantity of a cooling liquid to the ingot larger in the number of adjacent ingots.

3. The method of producing a continuously cast metal rod as recited in claim 1, wherein supply pressure of a cooling liquid to the ingot smaller in the number of adjacent ingots is set to be lower than supply pressure of a cooling liquid to the ingot larger in the number of adjacent ingots.

4. The method of producing a continuously cast metal rod as recited in claim 1, wherein a degree of cooling of each ingot is set to be equal to each other over an entire circumference of each ingot.

5. The method of producing a continuously cast metal rod as recited in claim 1, wherein when a region of an outer peripheral surface of the ingot that is open and does not face another ingot is defined as an open region, and a region of an outer peripheral surface of the ingot that faces another ingot is defined as an ingot facing region, the open region is cooled in a state in which a degree of cooling by a cooling liquid at the open region is set to be less than a degree of cooling of a cooling liquid at the ingot facing region.

* * * * *